US006326931B1

(12) United States Patent
Falk

(10) Patent No.: US 6,326,931 B1
(45) Date of Patent: Dec. 4, 2001

(54) SCANNING CONTINUOUS ANTENNA REFLECTOR DEVICE

(75) Inventor: Kent Olof Falk, Mölnlycke (SE)

(73) Assignee: Telefonaktiebolaget LM Ericsson (publ), Stockholm (SE)

( * ) Notice: Subject to any disclaimer, the term of this patent is extended or adjusted under 35 U.S.C. 154(b) by 0 days.

(21) Appl. No.: 09/717,001

(22) Filed: Nov. 22, 2000

(30) Foreign Application Priority Data

Nov. 23, 1999 (SE) ..... 9904235

(51) Int. Cl.[7] ..... H01Q 19/06
(52) U.S. Cl. ..... 343/757; 343/754
(58) Field of Search ..... 343/753, 754, 343/755, 756, 757, 785, 787, 909

(56) References Cited

U.S. PATENT DOCUMENTS 4,644,363 * 2/1987 Horn et al. ..... 343/785
5,729,239 * 3/1998 Rao ..... 343/753

OTHER PUBLICATIONS

Application for 09/717,066 filed Nov. 22, 2000 corresponding to Swedish Patent Application 9904234–3.

* cited by examiner

*Primary Examiner*—Don Wong
*Assistant Examiner*—James Clinger
(74) *Attorney, Agent, or Firm*—Burns, Doane, Swecker & Mathis, L.L.P.

(57) ABSTRACT

A method and a device are disclosed for the generation of a surface, the reflection phase gradient of which will be varied by means of a controllable static electric field. The present solution takes into account, instead of mainly the transmissive properties, also the reflection properties of an arrangement comprising a ferroelectric material. Such a reflecting surface may contribute to an entire antenna aperture, a portion of an antenna aperture or an element in a conventional array aperture. In a general case N lobes and M nulls are to be controlled at the same time. In such a case the surface will preferably be designed as a curved surface, for instance a rotation symmetric parabola, while in other cases the reflector element may be designed just as a plane mirror. An antenna comprising such a reflector element of ferroelectric material can also form a polarization twisting Cassegrain antenna with a flat or curved main reflector element. The reflector element in a typical embodiment consists of a plate (50) of a material presenting ferroelectric properties and provided on each side with electromagnetically transparent highly resistive films (24, 34) each fed by means of a pair of parallel highly conducive edge wires (22, 23 and 32, 33). By applying a controllable voltage across each pair wires the lobe of the continuous aperture scanning reflector antenna can be controlled in a plane X-Z by a voltage $U_x$ and in a plane Y-Z by a voltage $U_y$.

10 Claims, 3 Drawing Sheets

SCANNING CONTINUOUS ANTENNA REFLECTOR DEVICE

TECHNICAL FIELD

The present invention relates to a scanning continuous antenna reflector device, and more exactly to a method and a device providing control of the direction of a main lobe or lobes of a scanning antenna without mechanically moving the antenna.

BACKGROUND

Sometimes it is desirable to be able to quickly change radiation direction of an antenna. In other words the antenna lobe is to be quickly shifted or swept between different directions. The demand regarding time is often such that an arrangement for mechanical motions of the antenna is not feasible.

Today antenna arrays are used which contain elements in which a signal phase at each element may be individually set to achieve a control of the main direction of the antenna lobe. Another technique to achieve a control of a radiation lobe is to utilize what is normally referred to as an "optical phased array", which includes an adaptable lens which, for instance, is disclosed in a document U.S. Pat. No. 5,212,583. This document describes a device utilizing a single plate of a material presenting ferroelectric properties. The plate is provided with a ground-plane on one side and two orthogonal grids on the other side for radiation lobe control. Both the grids and the ground-plane are made in a transparent material, indium/tin oxide. However, this document only refers to optical systems and does not discuss whether this should work within the microwave range.

Two documents U.S. Pat. Nos. 4,706,094 and 4,636,799 both disclose a ferroelectric block between grids of parallel wires. According to the first document only controlling fields are used across the block, i.e. in the propagation direction of the wave. According to the other document the voltages at the wires are arranged such that the field may adopt arbitrary directions in the plane perpendicular to the wires. In the first document it is pointed out that the "normally" high conductive wires only transmits perpendicular, linear polarization but that they may be replaced by resistive wires being able to transmit also parallel polarization of acceptable loss.

WO,A1,93/10571 demonstrates a development of U.S. Pat. No. 4,636,799 where only fields perpendicular to the wires are used. Here only one layer of wires is needed and the ferroelectric material has been divided into a plurality of blocks such that the grid of wires can be disposed in the middle of the ferroelectric layer.

However it will be noted that, the documents cited above are addressing the use of highly conductive wires and a voltage gradient is then achieved by applying different voltages to the individual wires according to a given pattern. Furthermore the devices described are related to utilizing the ferroelectric material for "electro-optic lenses" which primarily directs the utilization to frequencies corresponding to electromagnetic radiation in the nanometer range.

Therefore there is still a demand for a method and a device, which will operate even at a much lower frequency range.

SUMMARY

The present invention discloses a method and a device for the generation of a surface, the reflection phase gradient or transmission phase gradient of which will be varied by means of a controllable static electric field. The present solution takes into account, instead of mainly the transmissive properties, also the reflection properties of an arrangement comprising a ferroelectric material. Such a reflecting surface may contribute to an entire antenna aperture, a portion of an antenna aperture or an element in a conventional array aperture. The division of the aperture will depend on how many degrees of freedom are desired to be able to be controlled simultaneously. In a general case N lobes and M nulls are to be controlled at the same time. In such a case the surface will preferably be designed as a curved surface, for instance a rotation symmetric parabola, while in other cases the reflector element may be designed just as a plane mirror.

According to the present invention an electromagnetically transparent highly resistive film is applied at both sides of a plate presenting ferroelectric properties. At two opposite edges of these resistive films highly conducting wires are applied and electrically connected along the resistive film. The pairs of highly conductive wires of the two films on the plate presenting the ferroelectric properties are running perpendicular to each other. The first pair of highly conducting wires parallel to the y-axis is connected to a first variable voltage source ($U_x$), while the second pair of highly conducting wires parallel to the x-axis is connected to a second variable voltage source ($U_y$). In this way a lobe may be steered in the plane X-Z by $U_x$ and in the plane Y-Z by $U_y$. In order to obtain low losses and no change of the controlling E field polarity when sweeping the voltage sources, a bias source of the order several hundreds of volts is applied between the two voltage sources. Another benefit of the present design is that it will operate independent of the polarization of the microwave power to be reflected by the present scanning reflector device.

A method according to the present invention is set forth by the attached independent claim 1 and by the dependent claims 2 to 4.

Similarly a continuous scanning antenna reflector device according to the method of the present invention is set forth by the attached independent claim 5 and further embodiments are defined in the dependent claims 6 to 10.

BRIEF DESCRIPTION OF THE DRAWINGS

The invention, together with further objects and advantages thereof, may best be understood by making reference to the following description taken together with the accompanying drawings, in which.

DETAILED DESCRIPTION

Example of embodiments

Figure 1:
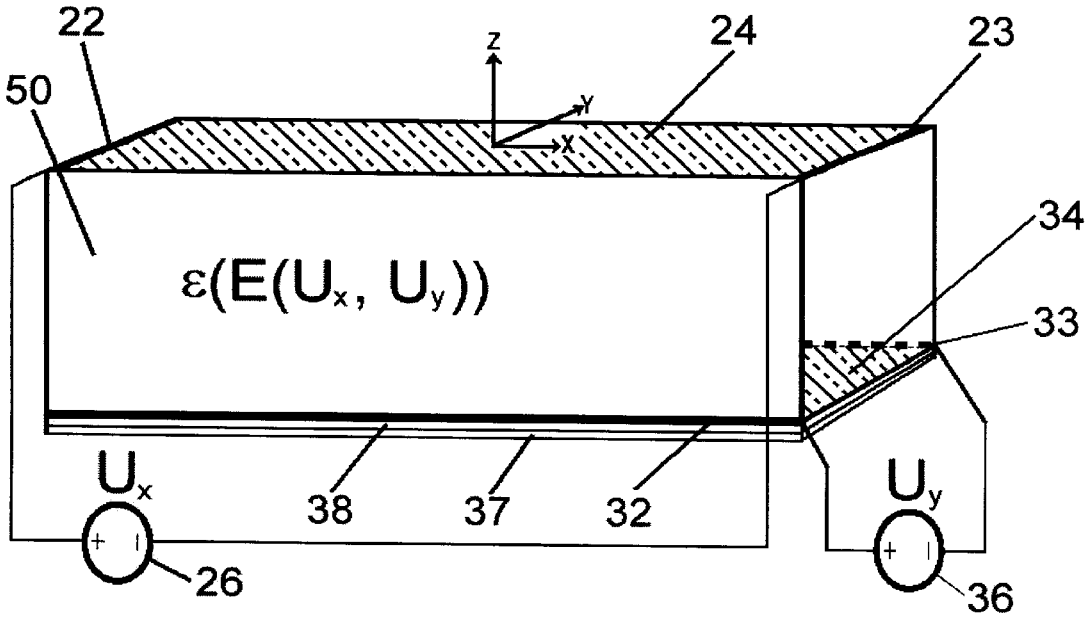
FIG. 1 is a sketch illustrating the principle according to a first embodiment of the present invention.

In a material presenting ferroelectric properties the dielectric properties will change under the influence of an electric field. This will be further discussed below in connection to a description of lobe control. Such a change of the dielectric properties of a ferroelectric plate will be utilized for creating a controllable continuous scanning antenna reflector element. The antenna aperture or a portion of an aperture may be built up by means of a reflector element having an electromagnetically transparent highly resistive (low conductivity) film layer 24, 34 on each side of a plate 50 made from a material presenting ferroelectric properties as is visualized in FIG. 1.

The plate 50 with the two highly resistive film layers 24 and 34 is then underneath the second highly resistive film layer 34 provided with a conducting plate 37 forming a ground plane which is insulated from the highly resistive film 34 by an insulating layer 38. If the structure of an antenna device using the continuous aperture scanning antenna reflector element according to the present invention itself offers a suitable ground-plane this may even replace the conducting plate 37. The conducting plate or ground-plane will reflect all RF power entering into the plate 50 back out again via the plate 50. The resistive film layers have to be thin, preferably of the order 1 to 10 $\mu$m, and transparent to an electromagnetic wave in a range, for instance, 30 to 60 GHz and present a very high resistance for instance of the order 500 MΩ/sqr. By forming a continuous resistive surface an electrostatic potential created across the surface of the film will be homogeneously distributed. By making the film very thin and with a very high surface resistance the power loss of a passing electromagnetic wave can be minimized. At two opposite edges of each one of the two layers of electromagnetically transparent, highly resistive films two highly conducting wires 22, 23 respectively 32, 33 are connected along the respective edges of the resistive film layers, and electrically connected to respective voltage terminals of variable voltage sources. In this way a static electric field will be created over each one of the highly resistive film layers perpendicular to their respective two edge-wires, and a phase gradient will be achieved across the plate 50 presenting ferroelectric properties when an electric field having a suitable gradient is applied across the plate in this way.

A variable voltage source ($U_x$) 26 is connected across the resistive film 24 by means of the highly conducting wires 22 and 23 and a first voltage potential gradient in the X direction will be distributed over the entire first film 24.

Figure 2:
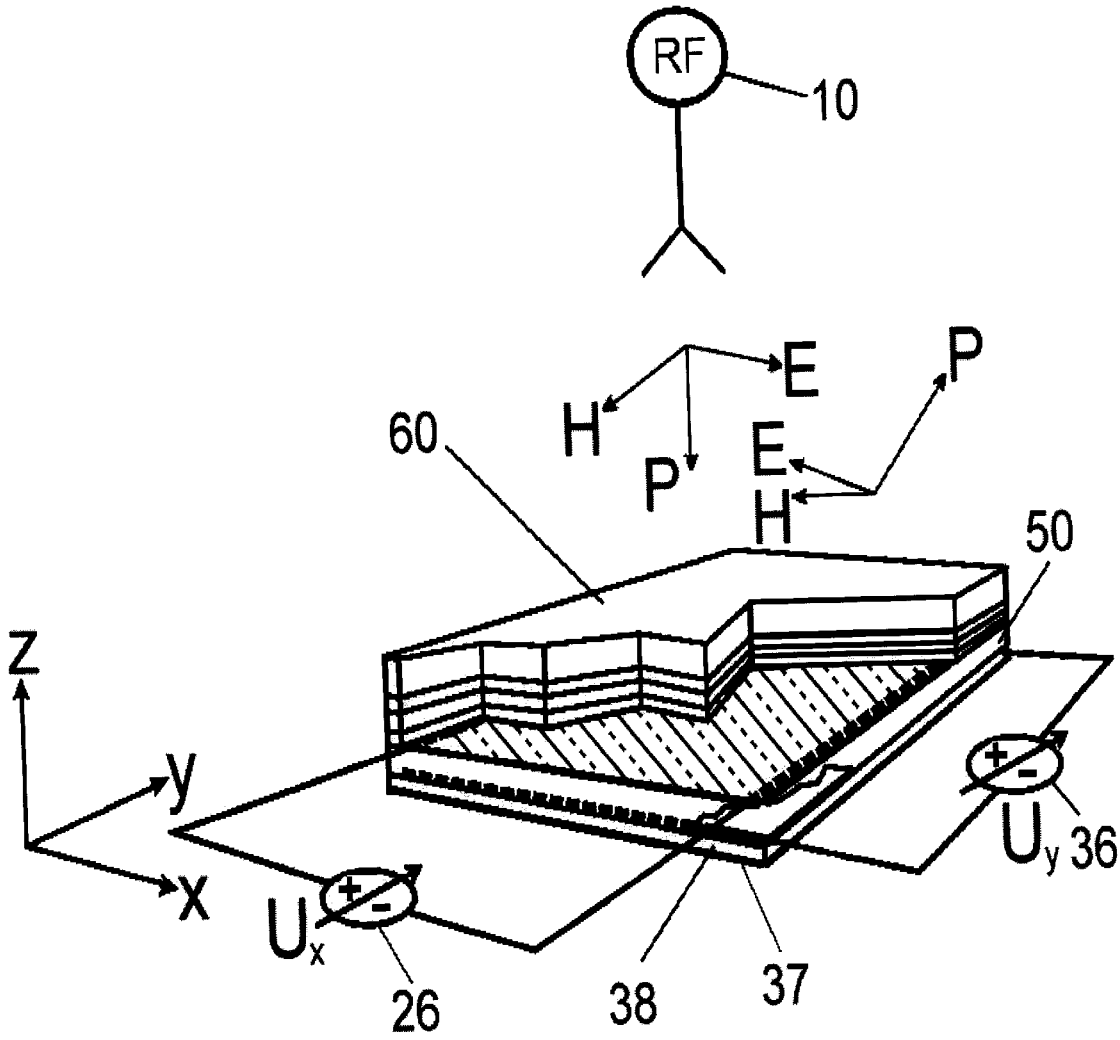
FIG. 2 illustrates a scanning antenna reflector element according to FIG. 1.

A second variable voltage source ($U_y$) 36 is connected to the wires 32 and 33, and consequently across the second resistive film 34. Due to the voltage applied across the resistive film 34 a second electric potential gradient will then be created in the Y direction. Now, as is indicated in FIG. 2, the lobe of the antenna having the continuous scanning reflector can by means of $U_x$ be controlled in the plane X-Z and by $U_y$ in the plane Y-Z. A RF microwave source 10 is illuminating the reflector device of FIG. 2. Here E represents the electric field vector and H the magnetic field vector of the propagating wave from the RF source, whereas P represents the propagation vector (or Poynting vector). However it should be noted that the operation of the present design will be independent of the polarization of the microwave entering into the reflector and being reflected by the scanning antenna reflector element. Thus, the polarization may be circular or linear at any arbitrary angle relative to the coordinate system for instance indicated in FIGS. 1 and 2. It should also be noted as the RF power will be passing through the plate 50 twice, the refracting action on the direction of the outgoing reflected lobe will be doubled compared to a lens device.

Figure 3:
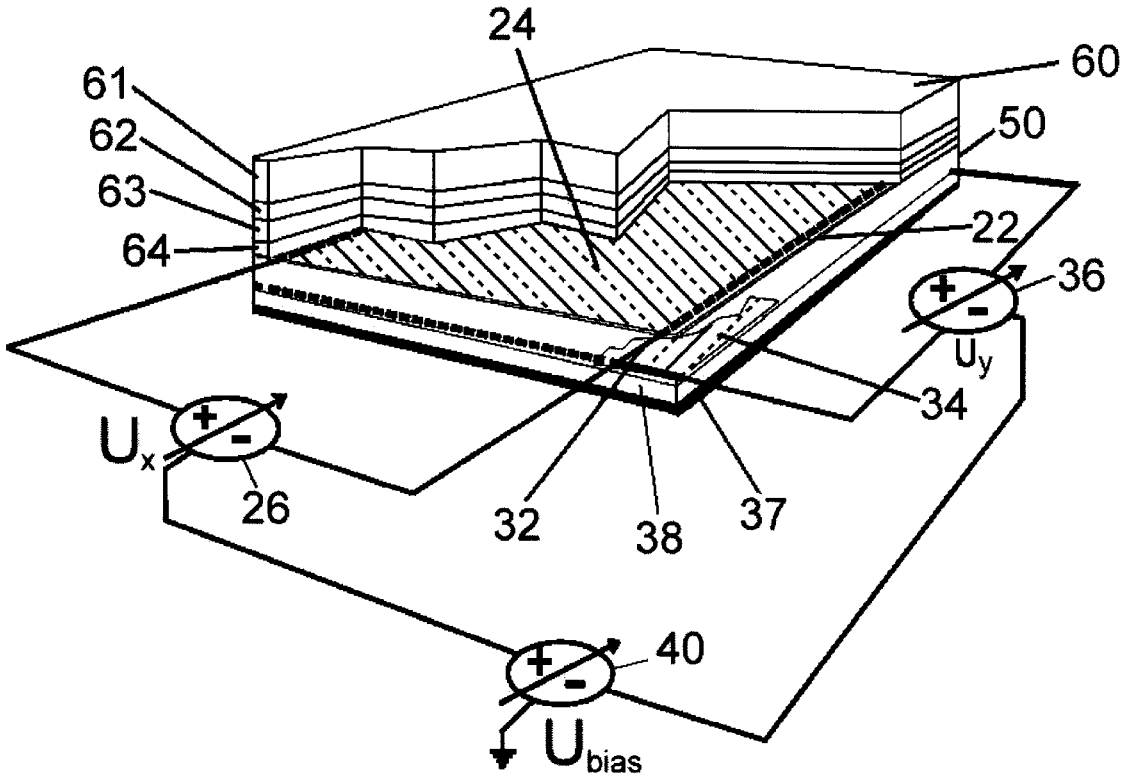
FIG. 3 is a more detailed illustration of an embodiment of the scanning antenna reflector device according to the present invention.

Further, similarly to FIG. 2, FIG. 3 demonstrates the structure of the continuous scanning reflector element, which will control a reflector antenna lobe in the plane X-Z by means of the voltage $U_x$ and in the plane Y-Z by means of the voltage $U_y$. In order to obtain low losses and no change of E field polarity when sweeping the voltages $U_x$ and $U_y$ a bias source 40 ($U_{bias}$) of the order 5 to 10 kV is applied between the two voltage sources 26 and 36 for the X and Y direction, respectively. The symbols shown simply indicate that the bias is connected within the voltage range of the variable sources, preferably at a center point. In a similar manner it is indicated by the grounding at the symbol of the bias source how the device of the illustrative embodiment is referenced to a system ground.

To achieve an impedance matching to the surroundings, it will in most of the cases be necessary to cover the upper surface of the reflector element side with an impedance transformer device 60. This transformer changes, step by step or continuously, the impedance level such that reflections, when the propagating wave enters or leaves the ferroelectric plate 50, become low enough within the operative frequency range. It is also possible to have the step by step or continuous change of impedance even entering into the ferroelectric material.

A typical desired frequency range for an antenna including the reflector element according to the present invention may be of the order 30–40 GHz. In a typical embodiment the reflector element comprises a flat slice 50 of the material presenting the ferroelectric properties. However, in another embodiment the reflector element may be designed to be, for instance, a curved main reflector element to create a scanning aperture. The ferroelectric material may even constitute a reflector element of a polarization twisting Cassegrain antenna.

In an illustrative embodiment the material presenting the ferroelectric properties may be in the form of a flat square slice 50 having measures of about 10×10 cm and a thickness of about 0.5 cm. For instance, typical such materials are barium titanate, barium strontium titanate or lead titanate in fine grained random polycrystalline or ceramic form. A suitable ceramic, for instance made available on the market by Paratek Inc., Aberdeen, Md., USA, is for instance a material identified as Composition 4, which presents a relative dielectric constant $\epsilon_r$ ($E_{DC}$=0)=118 and with a tunability of 10% according to the specification.

Returning to FIG. 3, a more detailed embodiment of the reflector element is demonstrated. The variable voltage sources 26 and 36 in this illustrative embodiment can apply a voltage of the order −700 to +700 volts between the highly conducting wires 22, 23 and 32, 33, respectively. Consequently, the voltage source 36 will provide the scanning in the Y direction, while the voltage source 26 will provide the scanning in the X direction.

Furthermore, on top of the slice 50 of the reflector element there is arranged an impedance transformer 60 to obtain an impedance matching for the present reflector element, which may represent an impedance value of the order of 40 ohms. The impedance transformer in the illustrative embodiment consists of a number of layers 61, 62, 63 and 64 of dielectric material presenting a stepwise change of the dielectric constant for a stepwise matching the impedance of the reflector element to the surroundings (e.g. free air ≈377 ohms).

Normally the conducting ground plane 37 will be referenced to the same ground as the bias source 40. In a preferred embodiment the insulating layer 38 underneath the second transparent highly resistive film layer 34 is a material, which presents a value of $\epsilon$ not being affected by the applied electric field to make certain that reflection takes place at a same impedance level over the entire lower surface of the reflector device.

Description of lobe control

If $U_x=U_y=0$ the antenna lobe will coincide with the surface normal surface in the simple case of a flat mirror surface element being illuminated by an incident field perpendicular to the flat surface element. When for instance $U_x$ and $U_y$ are changed to $U_{xo}$ and $U_{yo}$, respectively, it will be created a static electric field over the material presenting the ferroelectric properties in accordance to:

$$E(x,y)=(U_{xo}\cdot x/x_a-U_{yo}\cdot y/y_a+U_{bias})/d \quad (1)$$

d then representing the thickness of the material presenting the ferroelectric properties, $y_a$ representing the extension of the plate in the Y direction of the aperture and $X_a$ representing its extension in the X direction. If $\epsilon$ lies within a range being approximately linear as a function of E the dielectric constant (permittivity) will vary over the surface according to:

$$\epsilon(x,y)=\epsilon(U_{bias})-C\cdot E(x,y) \quad (2)$$

This results in a phase gradient over the surface for the reflected wave according to:

$$\Delta\phi(x,y)=(4\pi d/\lambda_o)\cdot\sqrt{\epsilon(x,y)} \quad (3)$$

The lobe will approximately point to the direction of the surface normal of the phase gradient in the middle of the aperture (x=y=0). The angle ($P_x$ between the axis Z and the projection of the lobe onto the plane X-Z will approximately become $$\Phi_x=\text{atan}(d/dx(\Delta\phi(x,y))|_{x=y=0}\cdot(\lambda_0/(2\pi))) \quad (4)$$

In an analogue was the angle $\Phi_y$ between the axis Z and the projection of the lobe onto the plane X-Y becomes approximately:

$$\Phi_y=\text{atan}(d/dy(\Delta\phi(x,y))|_{x=y=0}\cdot(\lambda_0/(2\pi))) \quad (5)$$

Consequently a full lobe control will simply be obtained in both of the planes X-Z and X-Y. A change of lobe direction is instantaneously obtained with a change of the applied electric voltage onto the two conductive wires connected to a respective edge of the resistive film.

Thus, as already mentioned another advantage of the present invention, which utilizes a reflector element design in relation to other applications, which are utilizing the transmissive property of ferroelectric material, is that the phase-shifting action of the ferroelectric plate will be utilized doubled.

Additionally the side, underneath the plate 50 of ferroelectric properties carrying its electromagnetically transparent highly resistive film 34, is coated with an insulating material 38 having a value of $\epsilon$ not being affected by the applied electric field, thereby avoiding that different portions of the reflector element reflect the lobe in a different direction. In this way all reflections takes place at the same impedance level over the entire reflector element.

It will be understood by those skilled in the art that various modifications and changes may be made to the present invention without departure from the scope thereof, which is defined by the appended claims.

What is claimed is:

1. A method for obtaining a continuous aperture scanning antenna reflector element comprising the steps of:

arranging a reflector element in the form of a plate of a material presenting ferroelectric properties;

arranging a first electromagnetically transparent, highly resistive film onto a first side of the plate of material presenting ferroelectric properties, the first highly resistive film at two opposite edges provided with a first and second highly conductive wire electrically connected along the respective opposite edge;

arranging a second electromagnetically transparent, highly resistive film onto a second side of the plate of material presenting ferroelectric properties, the second highly resistive film at two opposite edges provided with a third and fourth highly conductive wire electrically connected along the respective opposite edge, said third and fourth conducting wires of said second highly resistive film running perpendicular to said first and second wires of said first highly resistive film;

arranging a conducting reflector layer underneath said second highly resistive film, said reflector layer being insulated from said second film by an insulating layer;

connecting a first variable voltage source $U_x$ to said first and second conducting wires of said first highly resistive film forming a static potential gradient across said first highly resistive film, and connecting a second variable voltage source $U_y$ to said third and fourth highly conductive wires of said second highly resistive film to create a static potential gradient across said second highly resistive film, thereby forming perpendicular static E-fields across the plate;

illuminating said plate of material presenting ferroelectric properties carrying said first and second transparent highly resistive films with a microwave field of an arbitrary polarization, controlling the dielectric constant across the plate by controlling the voltages of said first and second voltage sources to thereby control a direction of an antenna lobe generated from reflected microwave power by means of the created scanning reflector antenna element.

2. The method according to claim 1, comprising the further step of arranging a biasing voltage $U_{bias}$ between said first and second electromagnetically transparent highly resistive films, or the first and second voltage sources, to obtain low loss operation and to guarantee no change of a static E-field polarity.

3. The method according to claim 1, comprising the further step of arranging an impedance matching to the surroundings by covering a side of the reflector element facing a microwave source with a transformation device which, step by step or continuously, changes the impedance such that the coupling to the surroundings becomes sufficiently high within an operative frequency range of the scanning antenna reflector element.

4. The method according to claim 1, comprising the further step of giving said insulating material a value of $\epsilon$ not being affected by an applied electric field to make certain that reflections at the ground plane takes place at a same impedance level over an entire lower surface of the scanning antenna reflector element.

5. A continuous aperture scanning antenna reflector device comprising a reflector element in the form of a plate of a material presenting ferroelectric properties;

a first electromagnetically transparent, highly resistive film onto a first side of the plate of material presenting ferroelectric properties, said first highly resistive film at two opposite edges provided with a first and second highly conductive wire electrically connected along the respective opposite edge;

a second electromagnetically transparent, highly resistive film onto a second side of the plate of material presenting ferroelectric properties, said highly resistive film at two opposite edges provided with a third and a fourth highly conductive wire electrically connected along the respective opposite edge, said third and fourth conducting wires of said second highly resistive film then running perpendicular to said first and second highly conducting wires of said first highly resistive film;

a conducting reflector layer underneath said second highly resistive film, said reflector layer being insulated from said second highly resistive film by an insulating layer; and a first variable voltage source $U_x$ is connected to said first and second conducting wires of said first electromagnetically transparent, highly resistive film forming a static potential gradient across said first highly resistive film, and a second variable voltage source $U_y$ is connected to said third and fourth highly conductive wires of said second electromagnetically transparent, highly resistive film to create a static potential gradient across said second highly resistive film, thereby forming perpendicular static E-fields across the plate; and wherein a first side of the plate of material presenting ferroelectric properties covered by said first highly resistive film being illuminated with a microwave source having an arbitrary polarization, whereby a dielectric constant across the reflector element is controlled by means of the voltage of said first and second voltage sources and thereby controlling a direction of an antenna lobe generated from reflected microwave power by means of the created scanning reflector antenna element.

6. The device according to claim 5, wherein a biasing voltage $U_{bias}$ is arranged between said first and second electromagnetically transparent, highly resistive films to obtain low loss operation and to guarantee no change of the static E-field polarity.

7. The device according to claim 5, comprising an impedance matching to the surroundings in the form of a transformation device covering the side of the reflector element with said first highly resistive film facing said microwave source, the transformation device, step by step or continuously, changing the impedance such that a coupling to the surroundings becomes sufficiently high within an operative frequency range of the antenna reflector element.

8. The device according to claim 5, wherein said reflector element of ferroelectric material constitutes a curved surface, e.g. a parabolic surface.

9. The device according to claim 5, wherein said reflector element of ferroelectric material constitutes a polarization twisting Cassegrain antenna with a flat or curved main reflector element.

10. The device according to claim 5, wherein said insulating layer underneath said second transparent highly resistive film presents a value of 6 not being affected by an applied electric field to make certain that all reflections at the ground plane take place at a same impedance level over an entire lower surface of the reflector element.

* * * * *